US008254801B2

(12) United States Patent
Zogg

(10) Patent No.: US 8,254,801 B2
(45) Date of Patent: Aug. 28, 2012

(54) GROUNDING ASSEMBLY FOR A DRUM IN AN IMAGE FORMING APPARATUS

(75) Inventor: Jon Peter Zogg, Chesapeake, VA (US)

(73) Assignee: Mitsubishi Kagaku Imaging Corporation, Chesapeake, VA (US)

( * ) Notice: Subject to any disclaimer, the term of this patent is extended or adjusted under 35 U.S.C. 154(b) by 505 days.

(21) Appl. No.: 12/513,174

(22) PCT Filed: Nov. 2, 2007

(86) PCT No.: PCT/US2007/083482
§ 371 (c)(1),
(2), (4) Date: Nov. 16, 2009

(87) PCT Pub. No.: WO2008/058008
PCT Pub. Date: May 15, 2008

(65) Prior Publication Data

US 2010/0067946 A1 Mar. 18, 2010

Related U.S. Application Data

(60) Provisional application No. 60/864,080, filed on Nov. 2, 2006.

(51) Int. Cl.
*G03G 15/00* (2006.01)

(52) U.S. Cl. ..... 399/90; 399/117

(58) Field of Classification Search ..... 399/90, 399/117, 159, 167
See application file for complete search history.

(56) References Cited

U.S. PATENT DOCUMENTS 5,052,090 A 10/1991 Kitaura et al.
5,752,136 A 5/1998 Sanchez et al.
5,845,173 A 12/1998 Zogg et al.
(Continued)

FOREIGN PATENT DOCUMENTS

CN 1677261 A 10/2005
(Continued)

OTHER PUBLICATIONS

Extended European Search Report issued May 2, 2011, in Application No. / Patent No. 07854571.2-2209 / 2078228 PCT/US2007083482.

(Continued)

*Primary Examiner* — David Gray
*Assistant Examiner* — G. M. Hyder
(74) *Attorney, Agent, or Firm* — Oblon, Spivak, McClelland, Maier & Neustadt, L.L.P.

(57) ABSTRACT

A flange assembly for a drum of an image forming apparatus. The flange assembly including a flange having a hollow portion that extends from a first end of the flange to a second end of the flange, and a grounding member provided within the hollow portion of the flange. The grounding member is configured to ground the drum by contacting a ground pin of the image forming apparatus when the drum and the flange assembly are mounted to the image forming apparatus. When the grounding member is provided within the hollow portion of the flange, an open space is provided along an entire length from the first end of the flange to the second end of the flange. The driving flange has a generally triangular-shaped drive member at a terminal end thereof, and the drive member is configured to mate with a drum drive assembly of the image forming apparatus.

24 Claims, 11 Drawing Sheets

U.S. PATENT DOCUMENTS

| | | | | |
|---|---|---|---|---|
| 6,771,915 | B2 * | 8/2004 | Cais et al. | 399/90 |
| 7,003,247 | B2 * | 2/2006 | Koishi et al. | 399/167 |
| 7,020,410 | B2 * | 3/2006 | Zogg et al. | 399/90 |
| 7,050,736 | B2 * | 5/2006 | Hale et al. | 399/90 |
| 7,672,613 | B2 * | 3/2010 | Shin | 399/159 |
| 7,844,198 | B2 * | 11/2010 | Kuwabara et al. | 399/117 |
| 8,073,362 | B2 * | 12/2011 | Deguchi | 399/159 |
| 2005/0111870 | A1 * | 5/2005 | Zogg et al. | 399/90 |
| 2006/0051133 | A1 * | 3/2006 | Koishi et al. | 399/167 |
| 2006/0165436 | A1 * | 7/2006 | Nishimura | 399/117 |
| 2009/0162093 | A1 * | 6/2009 | Shanun et al. | 399/109 |

FOREIGN PATENT DOCUMENTS

| | | |
|---|---|---|
| EP | 1 600 826 B1 | 11/2008 |

OTHER PUBLICATIONS

Supplementary European Search Report issued May 19, 2011 in Application No. 07854571.2.

* cited by examiner

ASSEMBLED VIEW

EXPLODED VIEW

SECTION A-A

SECTION A-A

SECTION C-C

SECTION B-B

FLAT PATTERN

DETAIL Z
SCALE 6:1

SECTION B-B
SCALE 6:1

ASSEMBLED VIEW

EXPLODED VIEW

SECTION A-A

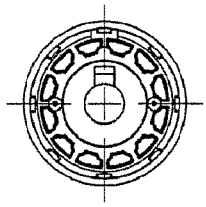
FIG. 30
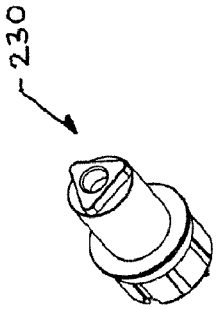
FIG. 25
FIG. 24
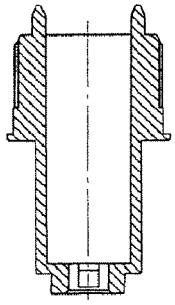
SECTION A-A
FIG. 29
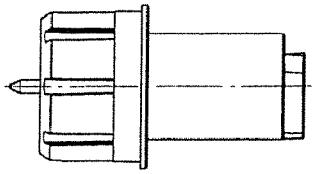
FIG. 26
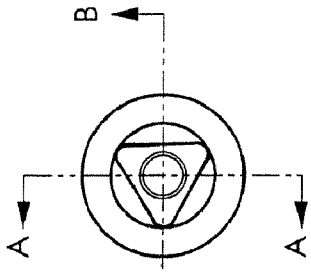
FIG. 27
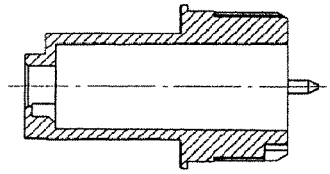
SECTION B-B
FIG. 28

GROUNDING ASSEMBLY FOR A DRUM IN AN IMAGE FORMING APPARATUS

BACKGROUND OF THE INVENTION

1. Field of the Invention

The present invention relates to an image forming apparatus, and particularly to an improved contact assembly for a drum, such as a photosensitive drum, for the image forming apparatus. More particularly, the invention provides an improved grounding assembly for the photosensitive drum.

2. Discussion of the Background

U.S. Pat. Nos. 5,845,173 and 7,020,410 provide background information regarding the field of art of the invention, and thus these references are hereby incorporated by reference in their entirety.

An image forming apparatus, such as a printer, a photocopier, etc., includes a photosensitive member, typically in the form of a photosensitive drum. The performance of the photosensitive drum is of critical importance, since the image being produced (or reproduced) is formed and developed on the drum. The developed image is then transferred from the drum to, e.g., a sheet of paper. Typically, the drum is formed of metal such as aluminum, and the metal is anodized or coated to provide a thin dielectric layer. The drum is then coated with photogeneration and photoconduction layers over the dielectric layer.

In forming an image, an electrostatic image is formed on the drum, and that image is developed with a developing medium, such as toner. Since the image is formed electrostatically, it is extremely important that any undesired charges or built-up charges are removed, or grounded from the drum utilizing a grounding expedient. This grounding must occur despite the anodized or coated layers which can be disposed on the drum, and which act as insulators.

In a known grounding arrangement, a grounding plate is fastened to a flange which extends into one end of the photosensitive drum. The flange is secured in place, for example, with an adhesive. This grounding plate includes radial projections, which make contact with an inner surface of the photosensitive drum to provide an electrical grounding contact therewith.

SUMMARY OF THE INVENTION

The inventor has constructed an improved grounding assembly for a flange of a photosensitive drum, as disclosed below.

BRIEF DESCRIPTION OF THE DRAWINGS

A more complete appreciation of the invention and many of the attendant advantages thereof will become readily apparent with reference to the following detailed description, particularly when considered in conjunction with the accompanying drawings, in which:

FIGS. 24-30 depict various views of the flange of the second embodiment;

FIGS. 33 and 34 are cross-sectional views.

DETAILED DESCRIPTION OF THE INVENTION

Figure 4:
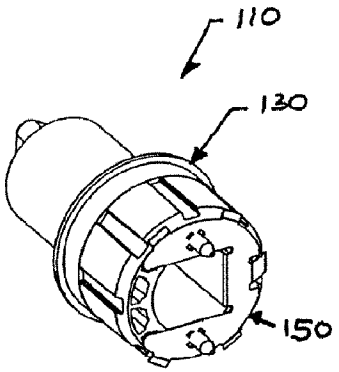
FIGS. 1-4 depict various views of a first embodiment of a flange assembly of the present invention, including a flange and a grounding member.
Figure 3:
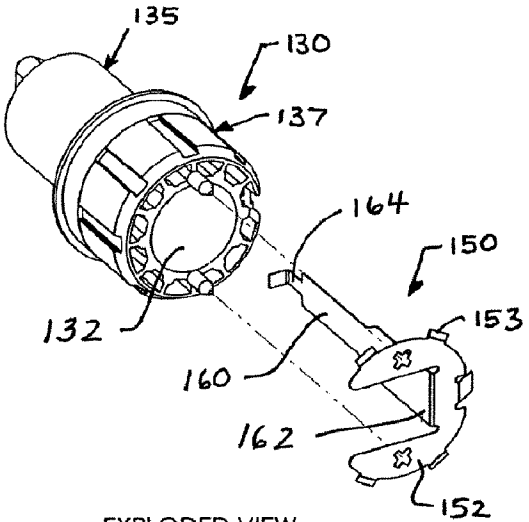

Embodiments of the present invention will be described hereinafter with reference to the accompanying drawings. In the following description, the constituent elements having substantially the same function and arrangement are denoted by the same reference numerals, and repetitive descriptions will be made only when necessary.

FIGS. 1-4 depict a first embodiment of a flange assembly 110 for a drum of an image forming apparatus. The flange assembly includes a flange 130 (see also, FIGS. 5-12) having a hollow portion 132 that extends from a first end 134 of the flange to a second end 136 of the flange, and a grounding member 150 (see also, FIGS. 13-19) provided within the hollow portion of the flange. The grounding member 150 is configured to ground the drum by contacting a ground pin of the image forming apparatus when drum and flange assembly are mounted to the image forming apparatus. The drum is mounted to the second end 136 of the flange 130 on outer surface 137, such that the projections on the base of the grounding member electrically contact an inner surface of the drum and thereby ground the drum. The flange 130 in FIGS. 1-4 is a driving flange having a generally triangular-shaped drive member 133 at a terminal end 134 thereof; however, other configurations of the driving flange can be used with the present invention, such as other shapes of the drive member (gear configurations, etc.). The drive member 133 is configured to mate with a drum drive assembly of the image forming apparatus, which drives the flange and drum in rotation such that surface 135 acts a rotational shaft surface of the flange.

Figure 2:
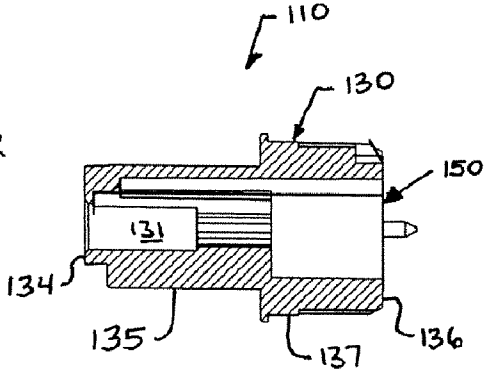
Figure 1:
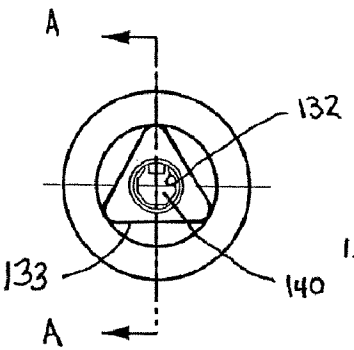
Figure 12:
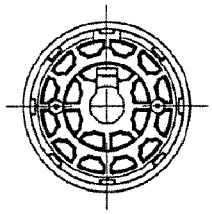
FIGS. 5-12 depict various views of the flange of the first embodiment.
Figure 6:
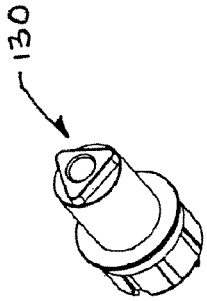
Figure 5:
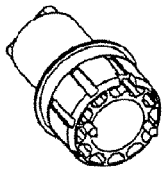
Figure 11:
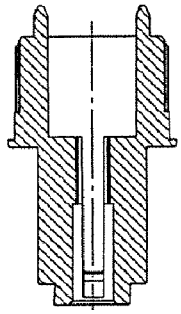
Figure 10:
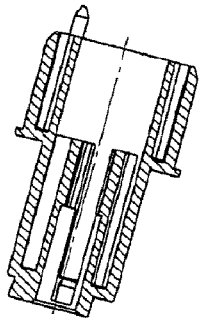
Figure 7:
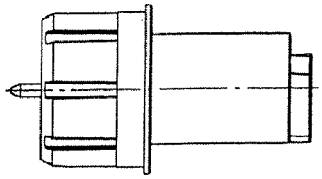
Figure 8:
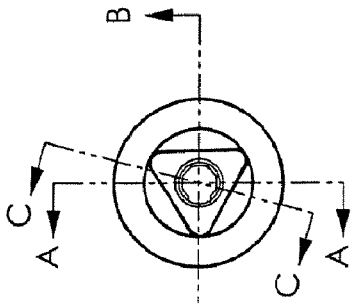
Figure 9:
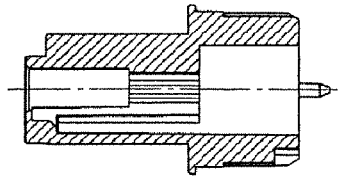
Figure 19:
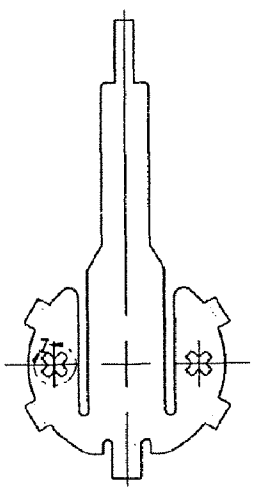
FIGS. 13-19 depict various views of the grounding member of the first embodiment.
Figure 13:
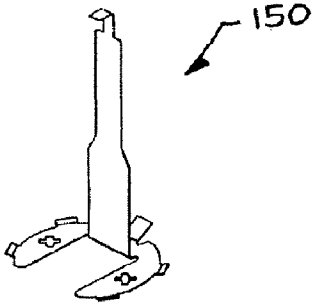
Figure 18:
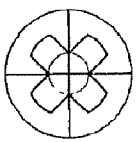
Figure 15:
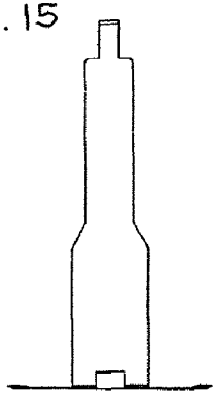
Figure 17:
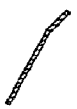
Figure 14:
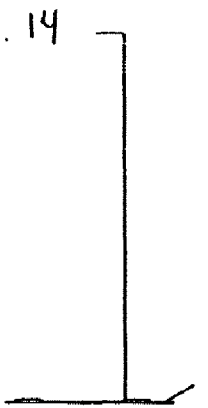
Figure 16:
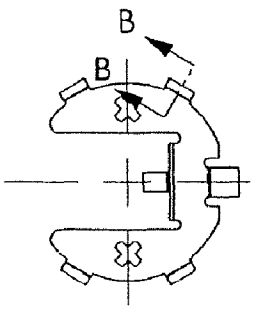
Figure 23:
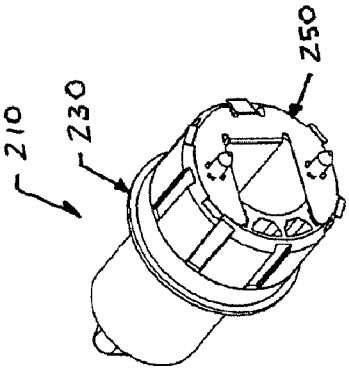
FIGS. 20-23 depict a second embodiment of a flange assembly of the present invention, including a flange and a grounding member.
Figure 22:
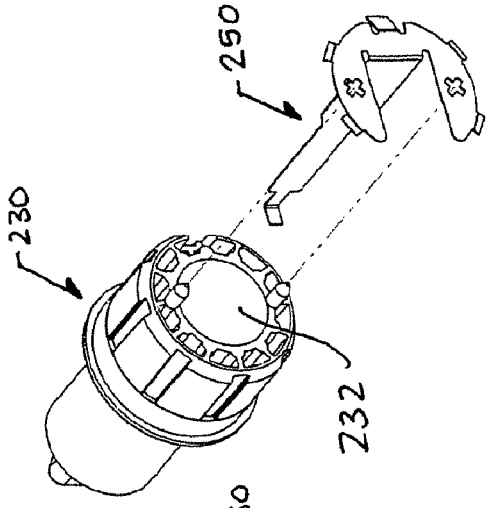
Figure 21:
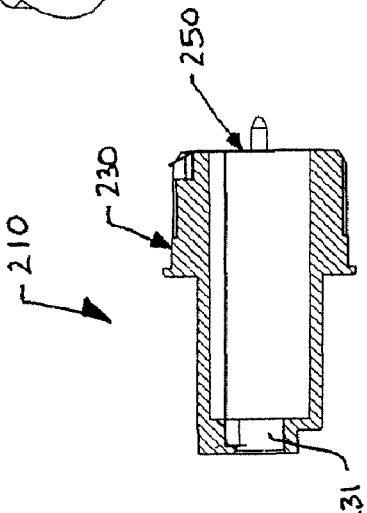
Figure 20:
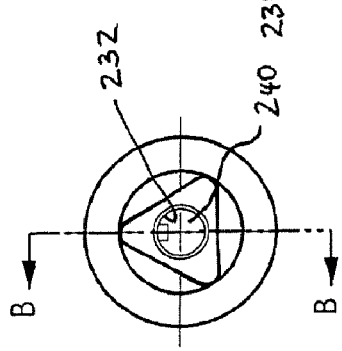

When the grounding member 150 is provided within the hollow portion 132 of the flange 130 (as depicted in FIGS. 1, 2, and 4), an open space 140 can be provided along an entire length from the first end 134 of the flange to the second end 136 of the flange; however, it is not necessary for an open space to be provided along an entire length of the flange but rather the open space can be configured to merely receive a ground pin of the image forming apparatus when drum and flange assembly are mounted to the image forming apparatus, or any variation of axial length of the open space therebetween. In a preferred embodiment, no part of the flange assembly is provided within the open space.

The grounding member 150 includes a base portion 152 attached to the second end 136 of the flange, and an arm portion 160 having a base end 162 and a contact end 164. The base end 162 is connected to the base portion 152, and the arm portion 160 extends from the base end 162 through the hollow portion 132 of the flange to the contact end 164 located at a position adjacent to the first end 134 of the flange.

Figure 31:
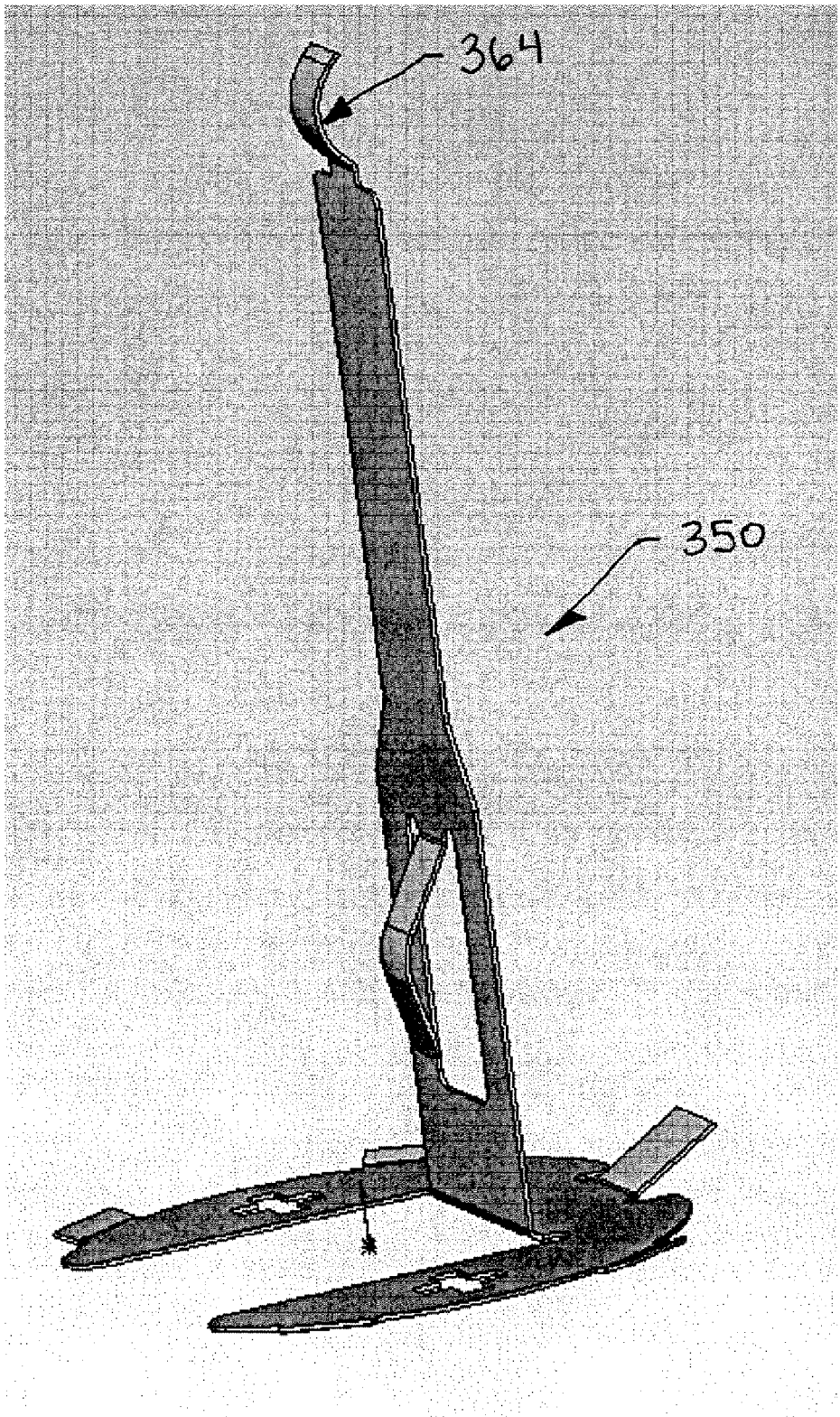
FIG. 31 depicts a perspective view of a grounding member of a third embodiment of the present invention.

The contact end 164 of the arm portion 160 extends outwardly from a side wall of the hollow portion 132 and protrudes within the hollow portion. The contact end depicted in the preferred embodiment has an L-shape. Alternatively, the contact end can have an arcuate shape, as with contact end 364 of the third embodiment of the grounding member 350 depicted in FIG. 31. In fact, the shape of the contact end of the present invention can have numerous different shapes and configurations as long as the contact end provides a grounding contact extending at least slightly outwardly from the side wall of the hollow portion 132 and is located at a position adjacent to the first end 134 of the flange such that the contact end can contact a ground pin of the image forming apparatus, which is provided within recess 131 of the flange 130.

Figure 32:
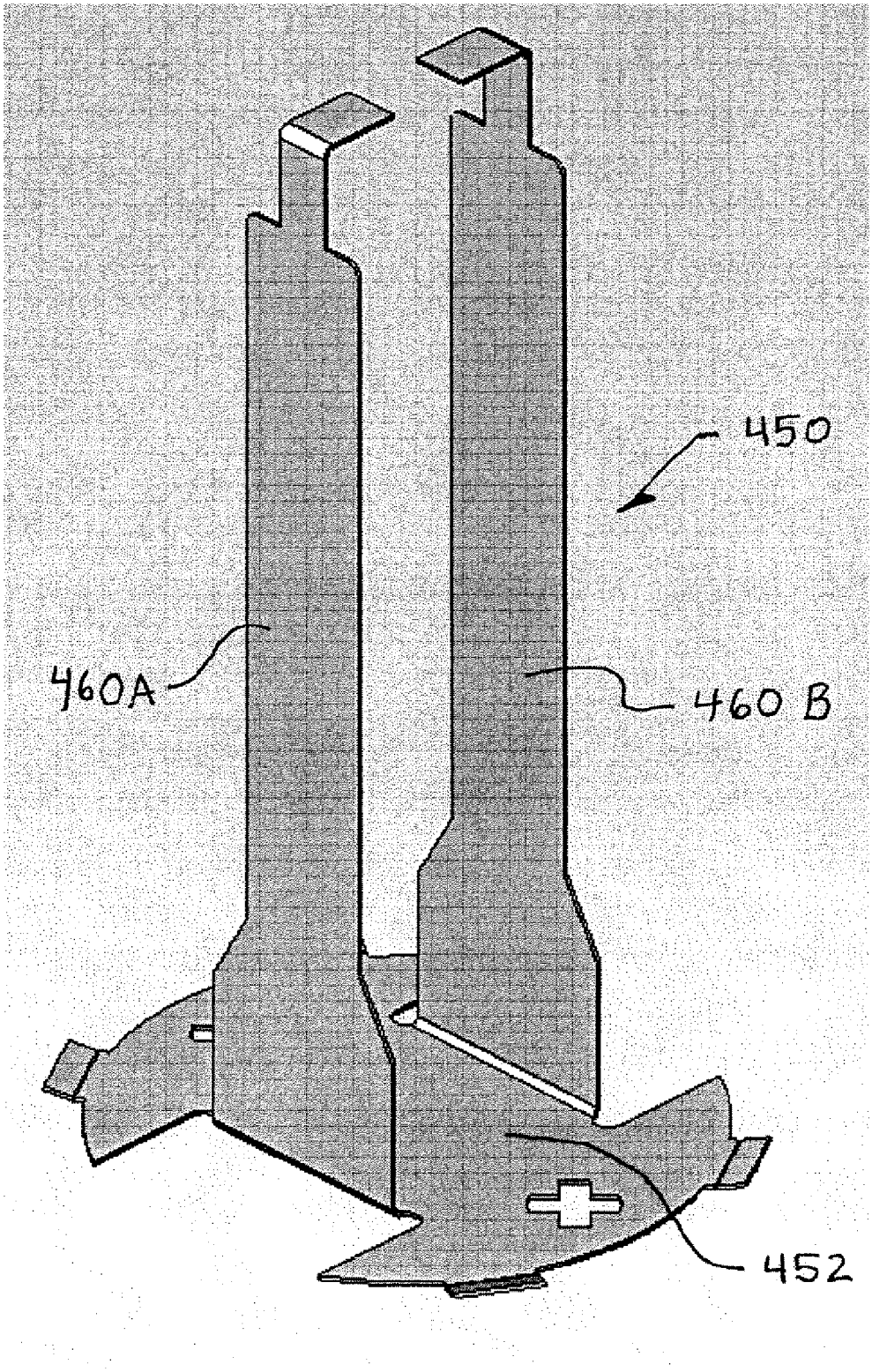
FIG. 32 depicts a perspective view of a grounding member of a fourth embodiment of the present invention.
Figure 33:
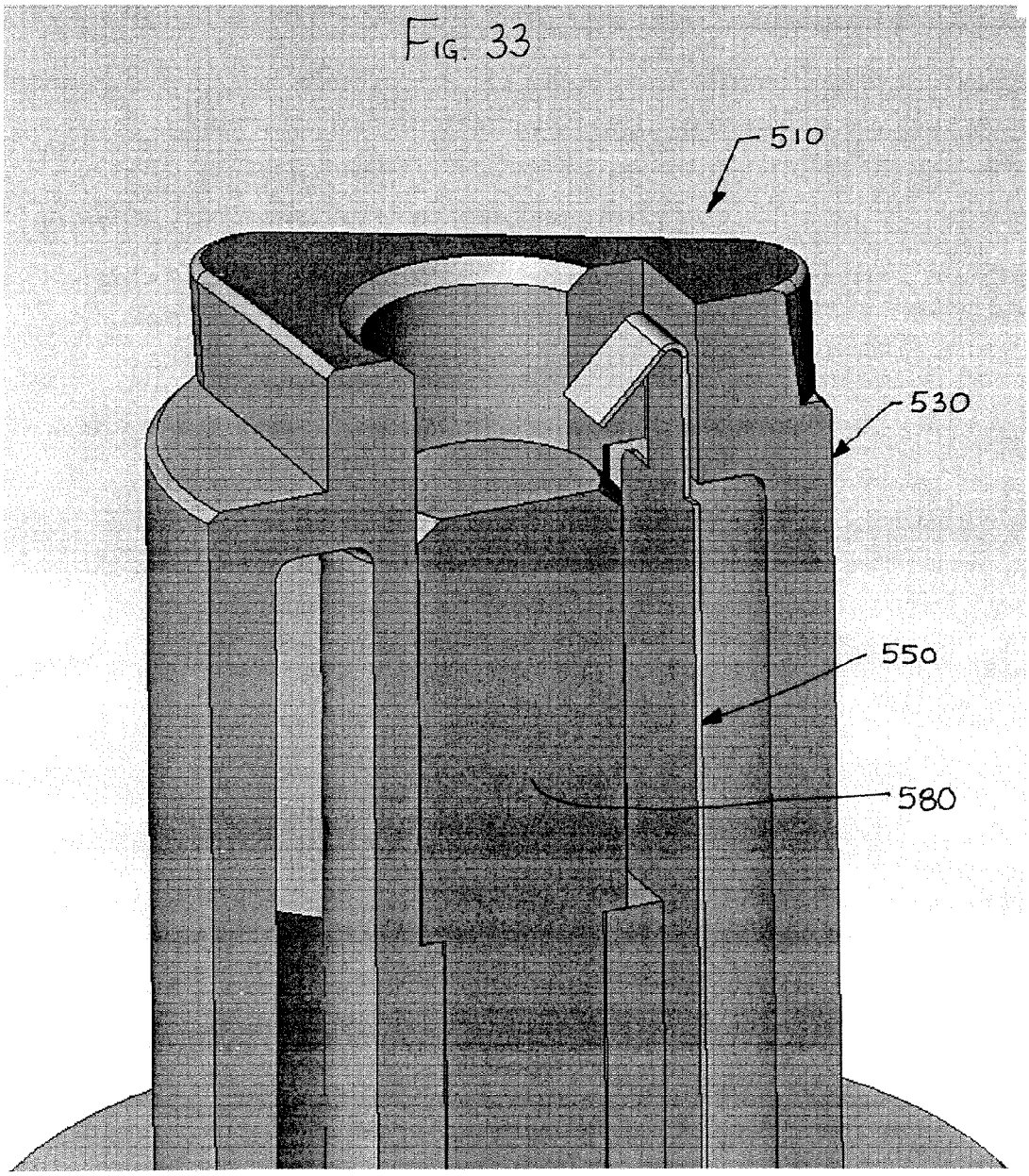
FIGS. 33-36 depict various views of a fifth embodiment of a flange assembly of the present invention, including a flange, a grounding member, and a flange grounding pin, where
Figure 34:
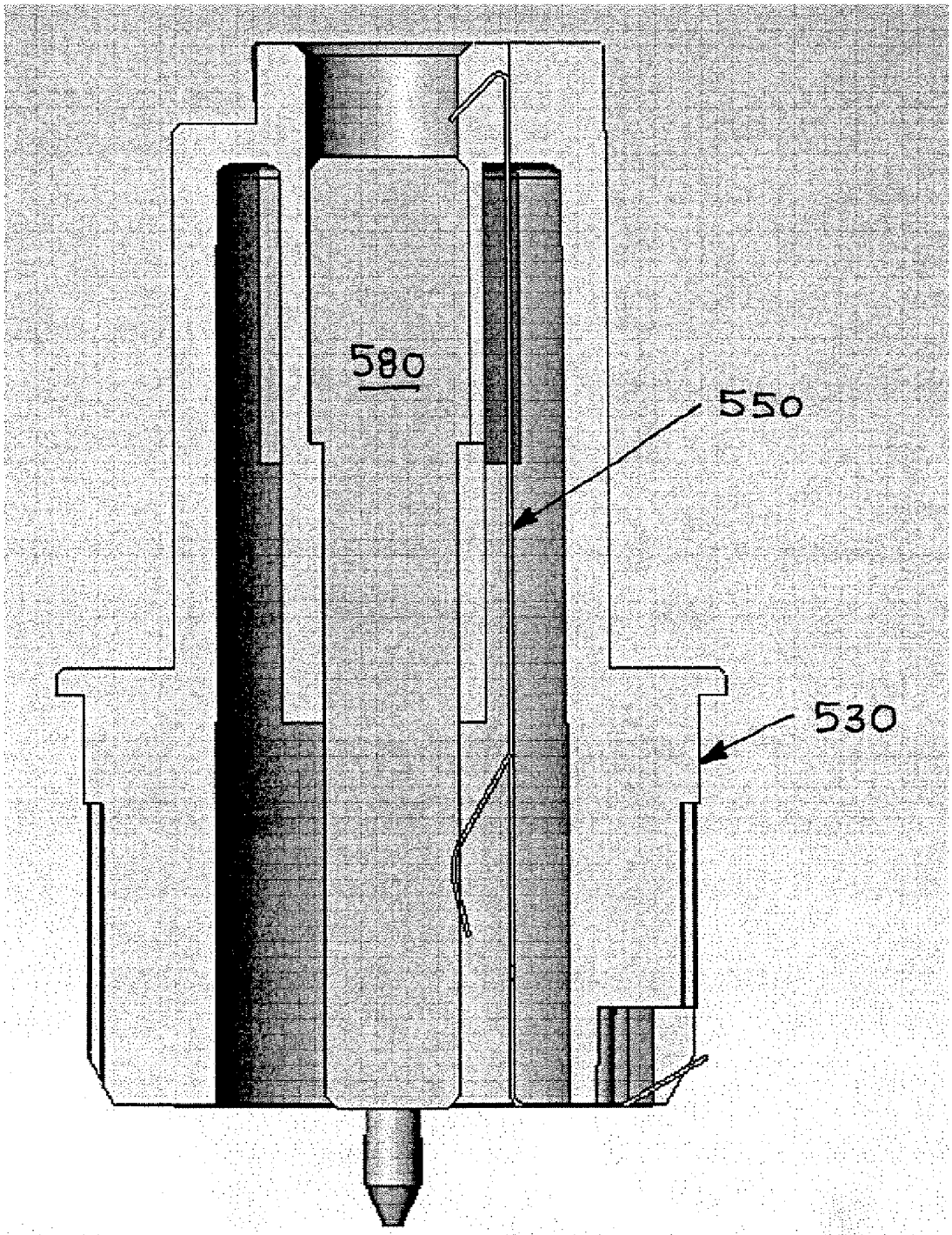
Figure 35:
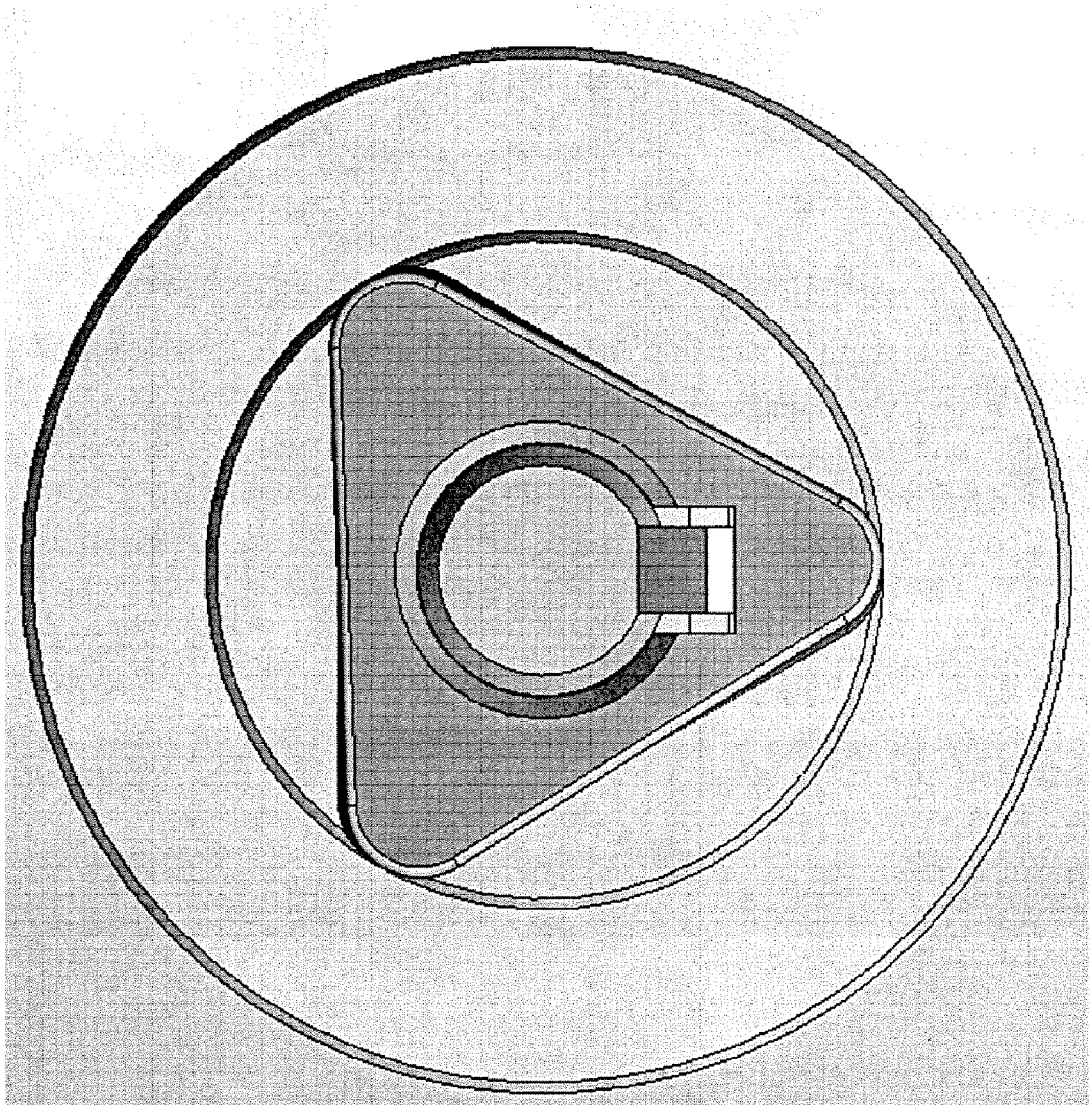
Figure 36:
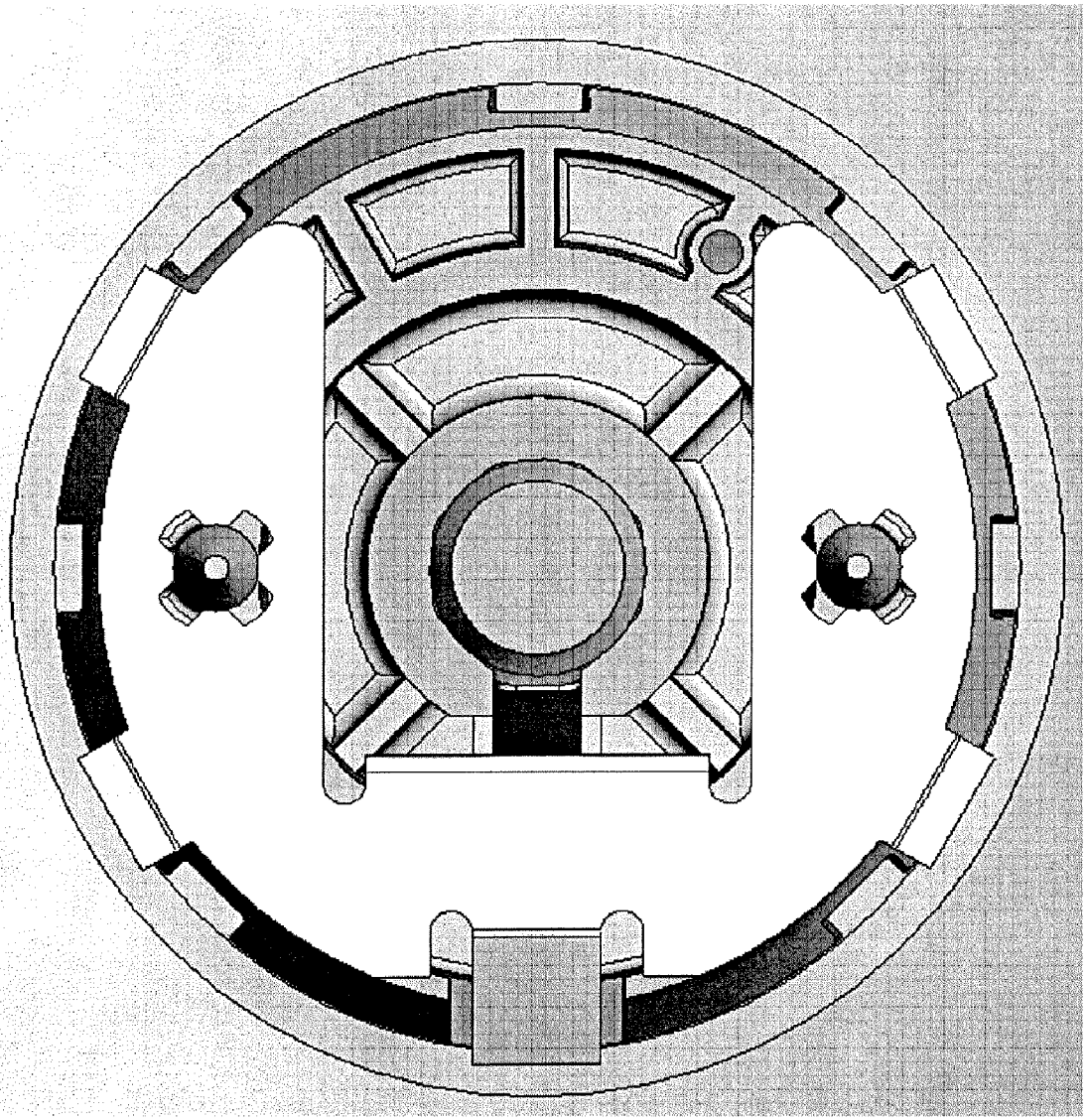

The grounding member 150 can include a base portion 152 and one or more arm portions connected to the base portion and extending within the hollow portion of the flange to positions adjacent to the first end of the flange. For example, the base portion can be provided with an annular shape and have one or more additional arm portions that are each a mirror image of the arm portion 160 of the preferred embodiment. In the case where additional arms are present, additional recesses within the hollow portion or additional hollow portions can be provided in the flange corresponding to each additional arm. FIG. 32 depicts a fourth embodiment of a grounding member 450 that includes a base portion 452 and two arm portions 460A, 460B that extend from the base portion 452.

The large base portion 152 that mounts to the back of the flange contacts the inside diameter of the aluminum OPC drum. The outer "ears" 153 on the grounding plate or grounding member 150 come in contact with the drum when the flange is pressed in and mounted thereto. Charge patterns on the OPC surface are generated by a laser interacting with the photoconductive coating to form an image. Toner particles of opposite electrical charge are attracted to the OPC surface in the pattern of the final image, and then transferred from there to the paper. Once a particular point on the circumference of the drum has completed this cycle, uniform charging must be restored for correct printing in the next revolution of the OPC. For all parts of this process, it is essential that the metallic substrate surface below the semiconductive and photosensitive layers be electrically grounded. In order to ensure that electrical grounding takes place, a grounding plate or grounding member is used. Thus, the grounding plate or grounding member touches the inside of the drum at the "ears", and then it touches the metal grounding pin from the image forming apparatus, thereby creating a grounding path for the drum. This path should remain constant and consistent while the drum is functioning in the apparatus.

FIGS. 20-23 depict a second embodiment of a flange assembly 210 for a drum of an image forming apparatus. The flange assembly includes a flange 230 (see also, FIGS. 24-30) having a larger hollow portion 232 and open area 240 therein than in the first embodiment, and a grounding member 250 (which in this depiction is identical to the grounding member 150 of the first embodiment; however, alternative configurations of the grounding member can be used herewith) provided within the hollow portion of the flange. The grounding member 250 is configured to ground the drum by contacting a ground pin of the image forming apparatus when drum and flange assembly are mounted to the image forming apparatus.

FIGS. 33-36 depict a fifth embodiment of a flange assembly 510 for a drum of an image forming apparatus. The flange assembly includes a flange 530 having a hollow portion therein, a grounding member 550, and a flange grounding pin 580, where the grounding member 550 and flange grounding pin 580 are provided within the hollow portion of the flange 530. The grounding member 550 in conjunction with the flange grounding pin 580 are configured to ground the drum by contacting a ground pin of the image forming apparatus when drum and flange assembly are mounted to the image forming apparatus. Accordingly, the ground pin of the image forming apparatus is intended to be received within the hollow portion of the flange and to contact both the contact end of the grounding member 550 and the end of the flange grounding pin 580 when the drum and flange assembly are mounted to the image forming apparatus.

The hollow portion of the present invention allows the drum to be stably mounted to the ground pin of the image forming apparatus and accurately positions the flange assembly with respect thereto. As can be seen in the first through fourth embodiments (FIGS. 1-32), the preset invention advantageously provides a configuration in which a flange grounding pin (such as that depicted in the fifth embodiment in FIGS. 33-36) is not required in order to achieve proper grounding of the drum and flange assembly. Furthermore, as can be seen in the first through third embodiments (FIGS. 1-31), the preset invention advantageously provides a configuration in which the grounding member does not require plural grounding contacts or plural arm portions in order to achieve proper grounding of the drum and flange assembly. Thus, the present invention provides an advantageous flange assembly that is easier and less costly to manufacture. The above advantages are surprising with respect to related art configurations, which not lead one of ordinary skill in the art to believe that the configurations of the present invention would achieve proper grounding absent the teachings of the present invention.

It should be noted that the exemplary embodiments depicted and described herein set forth the preferred embodiments of the present invention, and are not meant to limit the scope of the invention or the claims hereto in any way. The dimensions and various manufacturing instructions and restrictions set forth on the drawings submitted herewith represent a preferred embodiment of the invention, but are not meant to limit the scope of the invention or the claims hereto in any way.

Numerous modifications and variations of the present invention are possible in light of the above teachings. It is therefore to be understood that, within the scope of the appended claims, the invention may be practiced otherwise than as specifically described herein.

The invention claimed is:

1. A flange assembly for a drum of an image forming apparatus, said flange assembly comprising:

a flange having a hollow portion that extends from a first end of said flange to a second end of said flange; and a grounding member provided within said hollow portion of said flange, wherein said grounding member is configured to ground the drum by contacting a ground pin of the image forming apparatus when the drum and said flange assembly are mounted to the image forming apparatus, wherein said grounding member includes a base portion attached to said second end of said flange, and an arm portion having a base end and a contact end, said base end being connected to said base portion, said arm portion extending from said base end through said hollow portion of said flange directly to said contact end located at a position adjacent to said first end of said flange, and wherein said contact end of said arm portion extends outwardly from a side wall at said first end of said flange toward an interior of said hollow portion and protrudes within said hollow portion.

2. The flange assembly according to claim 1, wherein said hollow portion extends axially along an entire length of said flange.

3. The flange assembly according to claim 1, wherein, when said grounding member is provided within said hollow portion of said flange, an open space is provided along an entire length from said first end of said flange to said second end of said flange.

4. The flange assembly according to claim 3, wherein said open space extends axially along an entire length of said flange.

5. The flange assembly according to claim 1 further comprising a flange grounding pin provided within said hollow portion.

6. The flange assembly according to claim 1, wherein said contact end has an L-shape.

7. The flange assembly according to claim 1, wherein said contact end has an arcuate shape.

8. The flange assembly according to claim 1, wherein said grounding member further includes a plurality of arm portions connected to said base portion and extending within said hollow portion of said flange to positions adjacent to said first end of said flange.

9. The flange assembly according to claim 1, wherein said flange is configured to be a driving flange.

10. The flange assembly according to claim 9, wherein said driving flange has a generally triangular-shaped drive member at a terminal end thereof, said drive member being configured to mate with a drum drive assembly of the image forming apparatus.

11. The flange assembly according to claim 1, wherein the hollow portion of the flange is substantially cylindrical.

12. The flange assembly according to claim 1, wherein a length of the grounding member is substantially equivalent to a length of the flange.

13. A photosensitive drum assembly for an image forming apparatus, said photosensitive drum assembly comprising:

a drum having a first end and a second end;

a flange provided at said first end of said drum, said flange having a hollow portion that extends from a first end of said flange to a second end of said flange; and a grounding member provided within said hollow portion of said flange, wherein said grounding member is configured to ground said drum by contacting a ground pin of the image forming apparatus when said photosensitive drum assembly is mounted to the image forming apparatus, wherein said grounding member includes a base portion attached to said second end of said flange; and an arm portion having a base end and a contact end, said base end being connected to said base portion, said arm portion extending from said base end through said hollow portion of said flange directly to said contact end located at a position adjacent to said first end of said flange, and wherein said contact end of said arm portion extends outwardly from a side wall at said first end of said flange toward an interior of said hollow portion and protrudes within said hollow portion.

14. The photosensitive drum assembly according to claim 13, wherein said hollow portion extends axially along an entire length of said flange.

15. The photosensitive drum assembly according to claim 13, wherein said hollow portion extends axially along a rotation axis of said drum and said flange.

16. The photosensitive drum assembly according to claim 13, wherein, when said grounding member is provided within said hollow portion of said flange, an open space is provided along an entire length from said first end of said flange to said second end of said flange.

17. The photosensitive drum assembly according to claim 16, wherein said open space extends axially along an entire length of said flange.

18. The photosensitive drum assembly according to claim 13, further comprising a flange grounding pin provided within said hollow portion.

19. The photosensitive drum assembly according to claim 13, wherein said contact end has an L-shape.

20. The photosensitive drum assembly according to claim 13, wherein said contact end has an arcuate shape.

21. The photosensitive drum assembly according to claim 13, wherein said grounding member further includes a plurality of arm portions connected to said base portion and extending within said hollow portion of said flange to positions adjacent to said first end of said flange.

22. The photosensitive drum assembly according to claim 13, wherein said flange is configured to be a driving flange.

23. The photosensitive drum assembly according to claim 22, wherein said driving flange has a generally triangular-shaped drive member at a terminal end thereof, said drive member being configured to mate with a drum drive assembly of the image forming apparatus.

24. An image forming apparatus comprising: a photosensitive drum assembly as recited in claim 13.

* * * * *